United States Patent [19]

Piesinger

[11] 4,156,877

[45] May 29, 1979

[54] IN NULL STEERING APPARATUS A REFERENCE TO SPREAD SPECTRUM SIGNALS

[75] Inventor: Gregory H. Piesinger, Scottsdale, Ariz.

[73] Assignee: Motorola, Inc., Schaumburg, Ill.

[21] Appl. No.: 869,748

[22] Filed: Jan. 16, 1978

[51] Int. Cl.[2] ..... H01Q 3/26

[52] U.S. Cl. ..... 343/100 SA; 343/854

[58] Field of Search ..... 343/100 SA, 854

[56] References Cited

U.S. PATENT DOCUMENTS

| | | | |
|---|---|---|---|
| 4,032,922 | 6/1977 | Provencher | 343/854 |
| 4,079,379 | 3/1978 | Piesinger | 343/100 SA |

*Primary Examiner*—Maynard R. Wilbur
*Assistant Examiner*—Richard E. Berger
*Attorney, Agent, or Firm*—Eugene A. Parsons

[57] ABSTRACT

A transmitter for transmitting a desired signal composed of a carrier modulated by a pseudorandom noise code and periodic bursts of data and a receiver including null steering apparatus wherein the desired signal is applied to a demodulator for removing the PN code, or collapsing the spectrum of the signal, and the collapsed signal is demodulated to provide the data and the carrier, after which the carrier is remodulated with the PN code to provide a reference signal between bursts of data for the null steering apparatus to form a lobe in the antenna pattern in the direction of reception of the desired signal.

8 Claims, 3 Drawing Figures

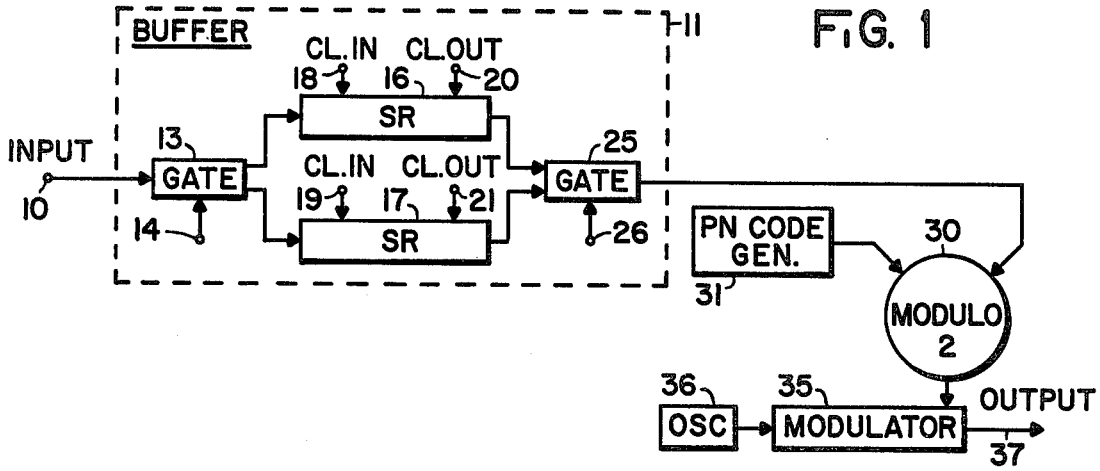
FIG. 1
FIG. 2
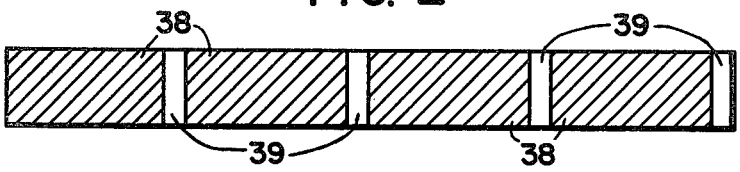
FIG. 3
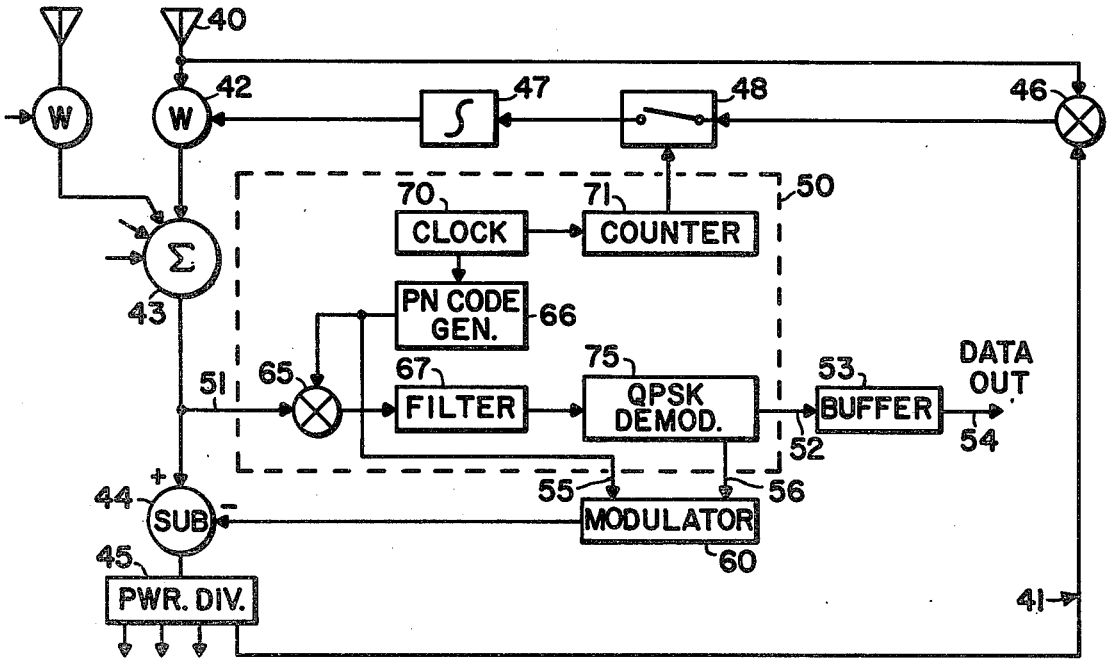

IN NULL STEERING APPARATUS A REFERENCE TO SPREAD SPECTRUM SIGNALS

BACKGROUND OF THE INVENTION

The present invention pertains to null steering apparatus in a communications system and apparatus for providing an improved reference signal for spread spectrum signals and the like. A copending application entitled "Null Steering Apparatus for a Multiple Antenna Array", Ser. No. 744,008, now U.S. Pat. No. 4,079,379, filed Nov. 22, 1976 by the same inventor and assigned to the same assignee, discloses apparatus for producing a reference signal for use in null steering apparatus when the desired signal is a carrier modulated by PSK data. A second copending application entitled "Null Steering Apparatus for a Multiple Antenna Array on an FM Receiver", Ser. No. 744,009, now U.S. Pat. No. 4,079,380, filed Nov. 22, 1976 by the same inventor and a coinventor and assigned to the same assignee, discloses apparatus for providing a reference signal in conjunction with an FM carrier wherein the data is periodically blanked for a very short period of time and the carrier is modulated only by a pseudorandom noise code during that period of time. In the receiver the PN code is removed from the carrier and the carrier is utilized as a reference only during the time that the data is blanked.

The present invention is an improvement over both of the inventions described in the copending applications in that none of the data is lost and a more accurate reference signal is produced.

SUMMARY OF THE INVENTION

The present invention pertains to null steering apparatus in a multiple antenna array wherein a carrier modulated by periodic bursts of data and by a random code is transmitted to a receiver incorporating a multiple antenna array with null steering apparatus and the null steering apparatus includes demodulation means for removing the random code to collapse the spread spectrum signal and provide signals corresponding with the carrier and with the periodic bursts of data, buffer means for converting the periodic bursts of data to a continuous data signal, modulation means for modulating the carrier from the demodulation means with the random code, switching means for activating the null steering apparatus only during the periods between bursts of data, and compensating means utilizing the random code modulated carrier from the modulation means to form a lobe in the antenna pattern in the direction of the desired signal.

It is an object of the present invention to provide new and improved null steering apparatus for use in conjunction with a communications system transmitting and receiving spread spectrum signals.

It is a further object of the present invention to provide new and improved null steering apparatus wherein an improved reference signal is provided without loss of data.

These and other objects of this invention will become apparent to those skilled in the art upon consideration of the accompanying specification, claims and drawings.

BRIEF DESCRIPTION OF THE DRAWINGS

Referring to the drawings,

FIG. 1 is a block diagram of a portion of a transmitter embodying a portion of the invention;

FIG. 2 is a representation of the transmitted signal from the transmitter of FIG. 1; and FIG. 3 is a block diagram of a multiple antenna array receiver incorporating null steering apparatus embodying the present invention.

DESCRIPTION OF THE PREFERRED EMBODIMENT

Referring specifically to FIG. 1, a simplified block diagram of a transmitter is illustrated. An imput terminal 10 is adapted to receive a continuous stream of digital data and supply the data to a buffer, generally designated 11. The buffer 11 includes circuitry for converting the continuous stream of data to periodic bursts, without the loss of information. The specific circuit illustrated in FIG. 1 is one embodiment for accomplishing this purpose and it should be understood that this embodiment is only illustrated for exemplary purposes.

The data at the input terminal 10 is supplied directly to a gate 13 having first and second outputs and a control input 14. The first output of the gate 13 is applied to a shift register 16 and the second output is applied to a shift register 17. The shift registers 16 and 17 have clock in terminals 18 and 19, respectively, and clock out terminals 20 and 21, respectively, for clocking information into the shift registers 16 and 17 at a first rate and clocking the information out at a second or higher rate. The outputs of the shift registers 16 and 17 are connected to two inputs of a gate 25 having a control terminal 26 and supplying output information from the buffer 11 to one input of a modulo 2 adder 30. Thus, by controlling the gates 13 and 25 through the control terminals 14 and 26, by means of logic circuitry not illustrated, the continuous stream of data can be clocked into the shift registers 16 and 17 at the lower or continuous rate and can be clocked out of the shift registers 16 and 17 at a higher rate to provide periodic bursts of data. The gates 13 and 25 alternate the shift registers 16 and 17 so that data is being clocked out of one shift register as data is being clocked into the other shift registers and as each shift register fills the gates 13 and 25 reverse.

The modulo 2 adder 30 has a second input with a random code generating means, in this embodiment a pseudorandom noise code generator 31, attached thereto. The modulo 2 adder 30 adds the PN code and the periodic bursts of data in a manner well known to those skilled in the art. The modulo 2 adder 30 supplies an output signal to a modulator 35 which also receives a continuous carrier from an oscillator 36. The carrier is modulated by the PN code and the periodic bursts of data in the modulator 35 and supplied for transmission at an output terminal 37. FIG. 2 is a representative illustration of the transmitted signal wherein the periodic bursts of data plus PN code modulated onto the carrier, areas 38, are interspersed with only the PN code modulated on the carrier, areas 39. In this embodiment, the modulator 35 is the type referred to as a spread spectrum modulator and may either biphase or quadphase modulate the carrier supplied thereto. In some spread spectrum applications, quadphase modulation is used instead of biphase because it has some desirable AJ and spectral properties that make it a more desirable modulation scheme than biphase.

Referring specifically to FIG. 3, a simplified block diagram of a multiple antenna array attached to a receiver incorporating null steering apparatus embodying the present invention is illustrated. A complete description of the multiple antenna array and the null steering apparatus, except for the production of a reference signal, is disclosed in the two above cited copending patent applications and will not be described in detail herein, except for the following cursory discussion. Only one antenna 40 of the multiple antenna array is discussed in conjunction with the block diagram of FIG. 3, since all of the antennas are connected in a similar fashion. Signals from the antenna 40 are supplied to a feedback loop, generally designated 41, which includes weighting means 42, a summing device 43 compensating means illustrated as a subtractor 44, a power dividing circuit 45, and correlating apparatus including a mixer 46 and integrator 47 with a switch 48 (illustrated schematically) therein. The switch 48 is located in the feedback loop 41 to activate the feedback loop, or allow operation thereof, only when the switch 48 is activated. It should be understood that the switch 48 is illustrated diagramatically and could take the form of any of a variety of apparatus for activating and deactivating the feedback loop 41 upon command.

Demodulation means, generally designated 50 is connected to receive input signals from the feedback loop 41 on an input line 51. The demodulation means 50 supplies the periodic bursts of data at an output 52, which periodic bursts of data are converted in a buffer 53, similar to the buffer 11 of the transmitter, into a continuous data stream at a data output terminal 54. Also, the demodulation means 50 supplies a random code signal, in this instance the PN code, at an output 55 and the recovered carrier at an output 56. The outputs 55 and 56 are connected to a modulator 60 which remodulates the carrier with the random code and supplies the modulated carrier to an input of the subtractor 44. The demodulation means 50 also supplies a control signal to the switch 48 so that the feedback loop 41 is activated only between the periodic bursts of data so that the random code modulated carrier applied to the subtractor 44 is substantially the same as the desired signal supplied to the subtractor 44 from the summing device 43, whereby the subtractor 44 essentially removes the desired signal from the feedback loop causing the null steerer to lobe on the desired signal and to null all other signals.

An exempliary embodiment of the demodulation means 50 is illustrated in FIG. 3. This embodiment includes a mixer 65 having one input connected to the line 51 and a second input connected to a PN code generator 66 with an output connected to a narrow band filter 67. The PN code generator 66 is synchronized with the PN code generator 31 in the transmitter by means of a clock 70 so that the PN code is removed from the input signal applied to the mixer 65 and the output signal is collapsed into a narrow band signal containing the carrier periodically modulated by bursts of data. An output from the clock 70 is also supplied through a counter 71, which provides the correct number of pulses with the correct spacing, to the control input of the switch 48 so that the switch 48 is activated only between bursts of data. The filter 67 is a narrow band filter which allows only the data modulated carrier to pass and rejects any other signals which may be present at the output of the mixer 65. The output signal from the filter 67 is then demodulated in a QPSK or PSK demodulator 75, typical examples of which are well known in the art. Periodic bursts of data are available at the output 52 from the demodulator 75 and the recovered carrier is available at the output 56. The output 55 is connected directly to the output of the PN code generator 66.

Thus, null steering apparatus for use with a multiple antenna array is disclosed wherein a reference signal is generated that periodically corresponds with the desired signal so that the null steering apparatus will lobe on the desired signal. During the periods when data is transmitted the feedback loop 41 remembers, or retains, the lobe generated during the time the feedback loop 41 was activated. Because the data is compressed into bursts, there is no loss of data and the generated reference signal exactly corresponds with the desired signal so that the lobing is very accurate.

While I have shown and described a specific embodiment of this invention, further modifications and improvements occur to those skilled in the art. I desire it to be understood, therefore, that this invention is not limited to the particular form shown and I intend in the appended claims to cover all modifications which do not depart from the spirit and scope of this invention.

What is claimed is:

1. A communications system comprising:

(a) a transmitter for transmitting a desired signal including
  (1) oscillator means for providing a carrier,
  (2) random code generating means providing a predetermined random code,
  (3) buffer means having an input for receiving a continuous data signal, said buffer means converting the continuous data signal to periodic bursts of data, and
  (4) modulating means coupled to receive the carrier, the random code and the periodic bursts of data and providing the desired signal including the carrier modulated by the random code and the periodic bursts of data, and (b) a receiver having a multiple antenna array connected thereto for receiving the desired signal from said transmitter, and null steering apparatus including
  (1) feedback means associated with each antenna in said array for adjusting the amplitude and phase of signals therein so that unwanted signals from the array are substantially cancelled,
  (2) random code generating means for providing an output signal substantially similar to the random code modulating the carrier of the desired signal,
  (3) demodulation means coupled to receive a portion of the desired signal from said feedback means and the output signal from said receiver random code generating means and to provide signals corresponding with the carrier and with the periodic bursts of data at outputs thereof,
  (4) buffer means coupled to receive the periodic bursts of data from said demodulation means and convert the bursts to a continuous data signal at the output,
  (5) modulation means coupled to receive the signal corresponding with the carrier from said demodulation means and the output signal from said receiver random code generating means for providing an output signal corresponding to the carrier modulated by the random code,
  (6) switching means coupled to said feedback means for activating said feedback means only during the time between bursts of data when the carrier is modulated only by the random code, said feedback means maintaining substantially the existing adjustment between activated periods, and (7) compensating means coupled to said feedback means for utilizing the output signal from said modulation means to form a lobe in the antenna pattern in the direction of the desired signal.

2. A communications system as claimed in claim 1 wherein the transmitter buffer means includes apparatus for receiving continuous data at a first rate and for providing all of the data in periodic bursts at a second rate higher than the first rate, and the receiver buffer means includes apparatus for receiving the periodic bursts of data and providing continuous data.

3. A communications system as claimed in claim 1 wherein the modulating means of the transmitter is a spread spectrum modulator and the random code generating means is a pseudorandom noise code generator, and the demodulation means of the receiver collapses the desired signal into the bandwidth of the carrier between bursts of data and the bandwidth of the carrier plus the data during bursts of data.

4. In a multiple antenna array, null steering apparatus for reception of a desired signal including a carrier modulated by periodic bursts of data and by a random code at least between said bursts of data, said null steering apparatus comprising:

(a) feedback means associated with each antenna in said array for adjusting the amplitude and phase of signals therein so that unwanted signals from the array are substantially cancelled;

(b) random code generating means for providing an output signal substantially similar to the random code modulating the carrier of the desired signal;

(c) demodulation means coupled to receive a portion of the desired signal from said feedback means and the output signal from said random code generating means and to provide signals corresponding with the carrier and with the periodic bursts of data at outputs thereof;

(d) buffer means coupled to receive the periodic bursts of data from said demodulation means and convert the bursts to a continuous data signal at the output;

(e) modulation means coupled to receive the signal corresponding with the carrier from said demodulation means and the output signal from said random code generating means for providing an output signal corresponding to the carrier modulated by the random code;

(f) switching means coupled to said feedback means for activating said feedback means only during the time between bursts of data when the carrier is modulated only by the random code, said feedback means maintaining substantially the existing adjustment between activated periods; and (g) compensating means coupled to said feedback means for utilizing the output signal from said modulation means to form a lobe in the antenna pattern in the direction of the desired signal.

5. Null steering apparatus as claimed in claim 4 wherein the carrier is PSK modulated and the demodulation means includes a PSK demodulator.

6. Null steering apparatus as claimed in claim 4 wherein the random code is a pseudorandom noise code.

7. Null steering apparatus as claimed in claim 6 wherein the desired signal is spread over a relatively wide spectrum by the modulation of the pseudorandom noise code on the carrier and the desired signal is collapsed into the bandwidth of the carrier and the bandwidth of the carrier plus the data by the demodulation means.

8. In a communications system including a transmitter and receiver with a multiple antenna array attached thereto and including null steering apparatus, a method of improving the null steering comprising the steps of:

(a) compressing the data to be transmitted into periodic bursts, and modulating the carrier with the periodic bursts of data and a random code between bursts to produce a desired signal;

(b) demodulating the received desired signal to remove the random code and insure the passage of only the desired signal;

(c) demodulating the previously demodulated signal to obtain periodic bursts of data and a recovered carrier;

(d) expanding the periodic bursts of data into a continuous stream of data;

(e) providing a random code in the receiver similar to the random code modulating the carrier in the transmitter;

(f) modulating the recovered carrier with the random code in the receiver; and (g) utilizing the random code modulated carrier in the receiver between the periodic bursts of data to form a lobe in the antenna pattern in the direction of the desired signal.

* * * * *